US006964103B2

(12) United States Patent
Chudek et al.

(10) Patent No.: US 6,964,103 B2
(45) Date of Patent: Nov. 15, 2005

(54) RETRACTABLE POINT COMPASS

(75) Inventors: Chris Chudek, Atlanta, GA (US); Marta Phillips, Fairfield, CT (US)

(73) Assignee: Acme United Corporation, Fairfield, CT (US)

( * ) Notice: Subject to any disclaimer, the term of this patent is extended or adjusted under 35 U.S.C. 154(b) by 0 days.

(21) Appl. No.: 10/657,722

(22) Filed: Sep. 8, 2003

(65) Prior Publication Data

US 2005/0050744 A1 Mar. 10, 2005

(51) Int. Cl.[7] ..... B43L 9/02
(52) U.S. Cl. ..... 33/27.02; 33/27.031; 401/6
(58) Field of Search ..... 33/27.02, 27.01, 33/27.031, 27.032, 27.033, 27.03, 27.06, 33/32.3, 666, 18.1, 18.2, 668; 401/6, 103; 16/430, 403

(56) References Cited

U.S. PATENT DOCUMENTS 779,082 A * 1/1905 Huber ..... 15/443
1,291,972 A * 1/1919 McGuigan ..... 401/88
2,045,298 A * 6/1936 Hanle ..... 33/27.02
2,537,058 A * 1/1951 Jamison et al. ..... 33/27.02
3,197,871 A * 8/1965 Stein et al. ..... 30/115
3,394,460 A * 7/1968 Stein et al. ..... 33/27.02
4,595,307 A * 6/1986 Heyden ..... 401/117
4,775,369 A * 10/1988 Schwartz ..... 604/263
5,056,945 A * 10/1991 Klodt ..... 401/6
6,146,038 A * 11/2000 Mittersinker et al. ..... 401/6
6,238,371 B1 * 5/2001 Himbert et al. ..... 604/187
6,311,404 B1 * 11/2001 Smith ..... 33/27.02

* cited by examiner

*Primary Examiner*—Christopher W. Fulton
*Assistant Examiner*—Amy R. Cohen
(74) *Attorney, Agent, or Firm*—Whyte Hirschboeck Dudek S.C.

(57) ABSTRACT

There is provided a compass assembly that includes a first member pivotally connected to a second member at a common end. The first member has an anchor point opposite the common end, and the second member retains a marking device opposite the common end. The compass assembly also includes a compressible cover positioned over the anchor point.

2 Claims, 13 Drawing Sheets

RETRACTABLE POINT COMPASS

BACKGROUND OF THE INVENTION

1. Field of the Invention

The present invention is related to a compass. More particularly, the present invention relates to a compass with a safety feature on an anchoring point.

2. Description of the Prior Art

A compass is a geometric instrument commonly known for describing arcs and circles. Compasses generally have a first member and a second member joined and articulated about a pivot joint. A sharp, needle-like anchoring point, positioned on an end of the first member and opposite the pivot joint, anchors the instrument to a surface. The second member commonly retains a marking instrument on an end opposite the pivot joint. As a user rotates the compass about the anchoring point, the marking instrument describes an arc.

Inherent in the use of a compass is a risk of injury resulting from inadvertent contact with the sharp anchoring point. Occasionally, improvements are made to the general compass design to protect the safety of a user. For example, some compass designs incorporate a spring loaded, retractable casing that encloses the sharp point during periods of non-use. Other compass designs completely eliminate the sharp point by providing a flat anchor foot hingedly attached to a compass leg. However, these complex designs typically bear an additional assembly cost because of the multiple components required for fabrication and assembly.

The method employed in the manufacture of a compass can also effect product safety. For example, the unyielding rigidity of metal and insert molded compasses may increase the severity of injury caused by inadvertent contact with the sharp anchoring point. In contrast, an inflexible metal or insert molded compass may pierce the skin of a user and cause painful injury. Alternatively, a plastic compass may bend or break apart upon inadvertent contact, thereby avoiding injury to the skin.

Further, the method of manufacture greatly effects the cost of the article of manufacture. Typically, compasses are manufactured from stamped metal or insert molded plastic and are generally more costly to produce than those compasses produced solely through a simple, relatively inexpensive injection molding process.

In addition to safety and cost concerns, prior compass designs are often difficult to use due to the design of the gripping member located at the pivot joint. Typically, compasses are designed to allow the user to hold and spin the instrument by grasping and rotating a small, narrow gripping member. Because of the gripping member's small size, a user generally grasps the gripping member with only two fingertips, which increases the likelihood of the instrument slipping during rotation. However, to draw a smooth and continuous arc, a comfortable and secure grasp is required. This is especially important if a user, such as a small child, lacks dexterity.

Accordingly, a need exists for compasses that are safe, inexpensive to manufacture, and easy to use.

SUMMARY OF THE INVENTION

It is an object of the present invention to provide a compass that is safe, inexpensive to manufacture, and easy to use.

It is also an object of the present invention to provide a compass manufactured from plastic and with a compressible cover encasing the anchoring point.

It is a further object of the present invention to provide a compressible cover for covering the anchoring point in a safety position.

It is still a further object of the present invention to provide a compass that has a compressible cover that is a unitary, elastomeric plastic member.

It is yet a further object of the present invention to provide a compass with a compressible cover that compresses to expose the anchoring point when the compressible cover is pressed against a surface.

It is yet still a further object of the present invention to provide a compressible cover that retracts to a neutral position and thereby extends past the anchoring point when lifted from a surface.

It is another object of the present invention to provide a compass that has a comfortable and sizeable gripping member that enables dexterous use.

It is yet another object of the present invention to provide a compass with a gripping member that has a textured gripping surface.

It is still another object of the present invention to provide a compass with a distance guide to indicate the radius of the arc described by the compass.

These and other objects and advantages of the present invention are achieved by a compass assembly having a first member pivotally connected to a second member at a common end. The first member has an anchoring point opposite the common end and the second member retains a marking device opposite the common end. A compressible cover is movably positioned over the anchoring point.

The present invention also provides a compass assembly having a first member pivotally connected to a second member, a gripping member connected to the first member and the second member, and a compressible cover movably positioned over a pointed end of the first member.

The present invention further provides a method of employing a compass assembly that includes pivoting a first member relative to a second member, wherein the second member has a marking device thereon, and grasping a gripping member connected to the first member and the second member. The method also includes applying pressure in the direction of a working surface on an elastomeric compressible member covering a pointed end of the first member so that the pointed end protrudes from the elastomeric compressible member, thereby anchoring the compass assembly to the surface. The method further includes rotating said compass assembly so that the marking utensil describes an arc on the surface. Finally, the method includes lifting the compass assembly from the surface so that the compressible member extends to a neutral position wherein the pointed end is covered.

The above-described and other features and advantages of the present invention will be appreciated and understood by those skilled in the art from the following detailed description, drawings, and appended claims.

DETAILED DESCRIPTION OF THE INVENTION

Figure 1:
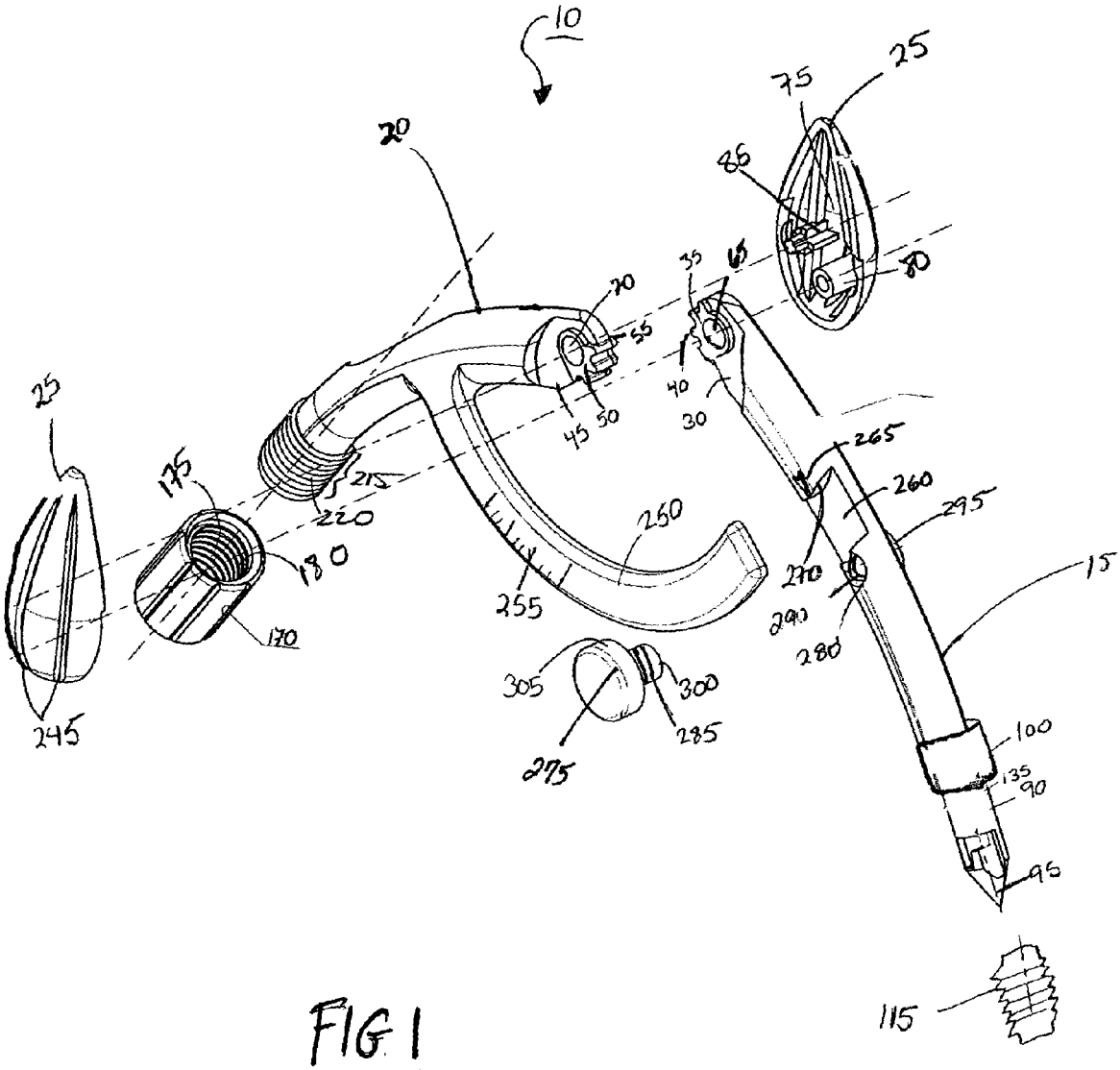
FIG. 1 is a perspective exploded view of the compass assembly according to the present invention.
Figure 2:
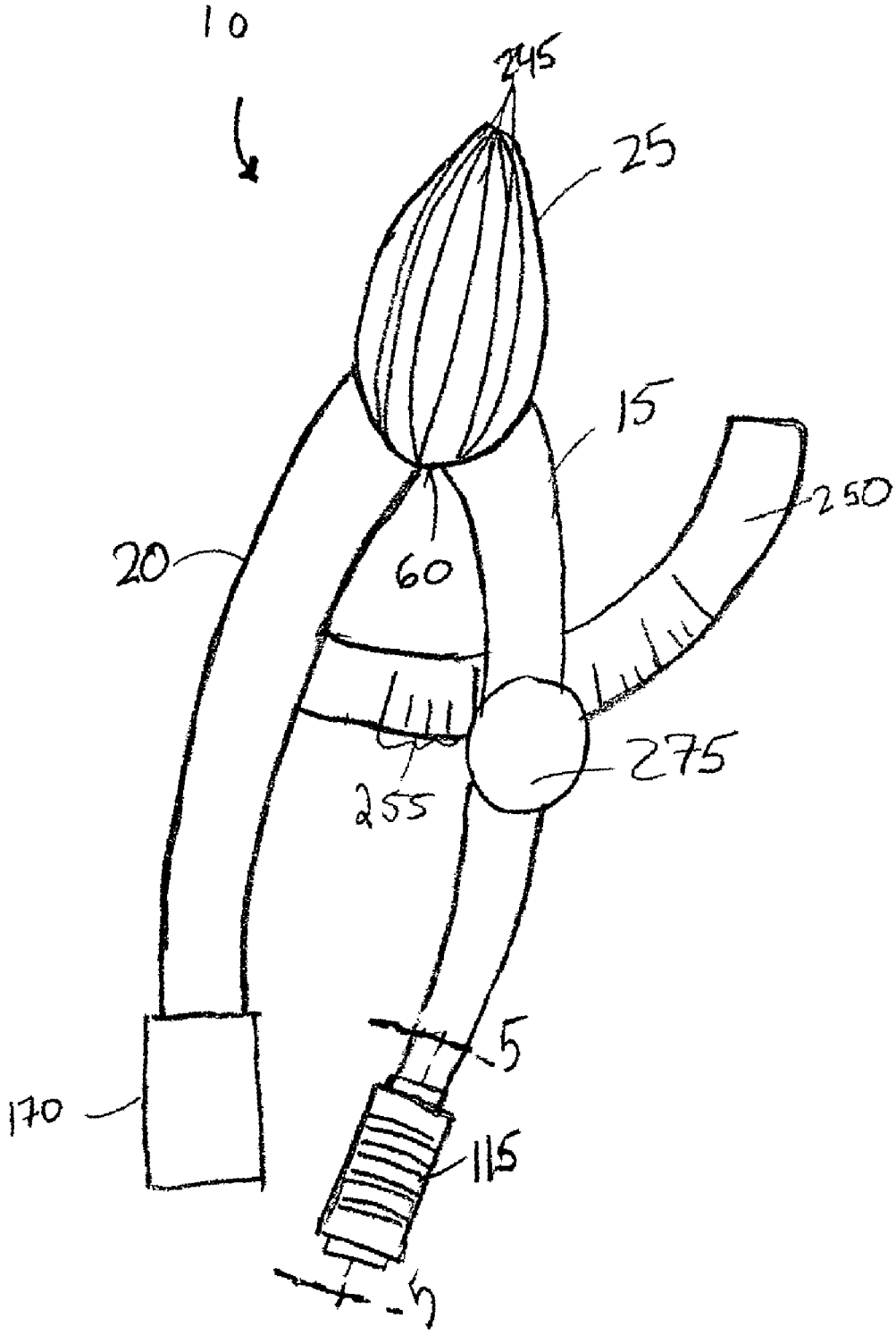
FIG. 2 is a front view of a compass assembly of the present invention.

Referring now to the figures, and in particular to FIGS. 1 and 2, a compass assembly generally represented by reference numeral 10 is shown. Compass assembly 10 has a first member 15, a second member 20, and a gripping member 25. Referring to FIG. 1, first member 15 has a first flange 30 and a first gear-like projection 35 having a first set of teeth 40. Flange 30 is preferably recessed. Similarly, second member 20 has a second flange 45 and a second gear-like projection 50 having a second set of teeth 55, for interlocking with first set of teeth 40 at a common point 60 shown in FIG. 2. Second flange 45 is also preferably recessed. First and second members 15 and 20 articulate about common point 60, so that they pivot in a longitudinal axis with respect to each other.

Referring again to FIG. 1, first flange 30 has a first bore 65 therethrough, and second flange 45 has a second bore 70 therethrough. First flange 30 and second flange 45 are connected together and a gripping member 25 is inserted thereon. Gripping member 25 has an interior surface 75 to which a first post 80 and a second post 85 (not shown) are connected. First and second bores 65 and 70 align with first and second posts 80 and 85 (not shown), respectively, further aligning first and second members 15, 20 at common point 60 shown in FIG. 2.

Referring again to FIG. 1, first member 15 is preferably a unitary member having a cylindrical stem 90 with an anchor point 95 opposite first bore 65. A cylindrical ridge 100 extends from first member 15. Cylindrical stem 90 and anchor point 95 extend from cylindrical ridge 100. Referring again to FIG. 3, first member 15 preferably has a first flat surface 105 opposite and adjoined to a first curved surface 110, as shown in FIG. 4. First curved surface 110 is flush with cylindrical ridge 100.

Referring again to FIG. 1, anchor point 95 has a compressible point cover 115 that is releasably connected to anchor point 95. Compressible point cover 115 protectively encases anchor point 95 during periods of non-use.

Figure 5:
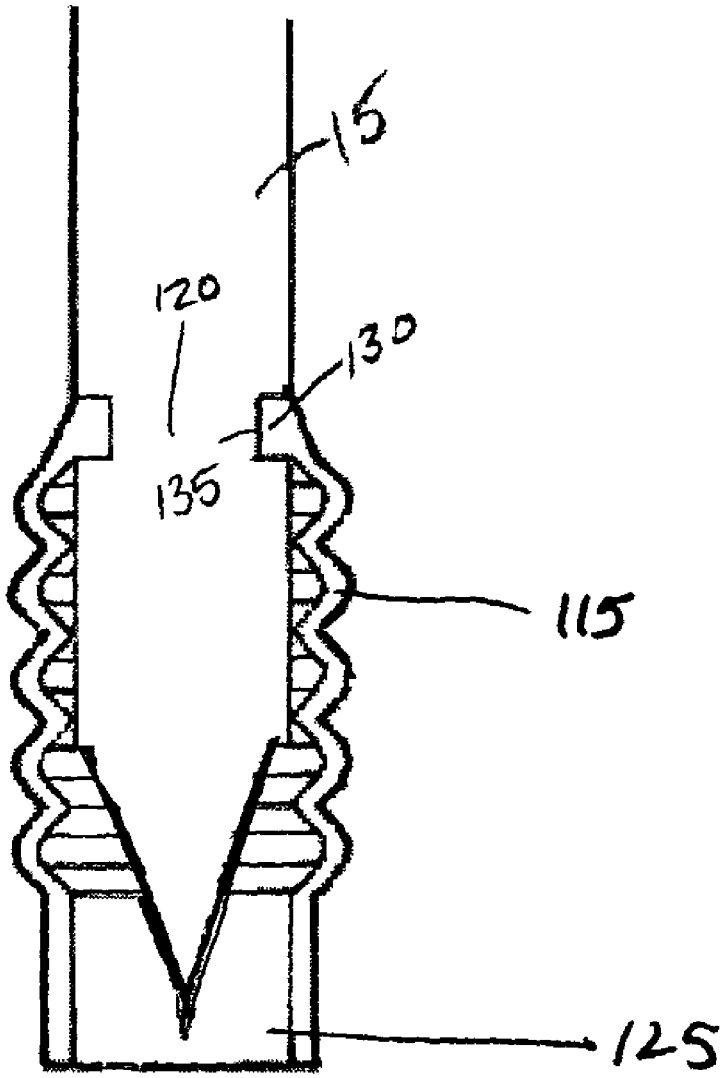
FIG. 5 is a sectional view of a preferred embodiment of the compressible point cover of the compass assembly of the present invention taken along line 5—5 of FIG. 2 in which the compressible point cover is in the neutral position.
Figure 6:
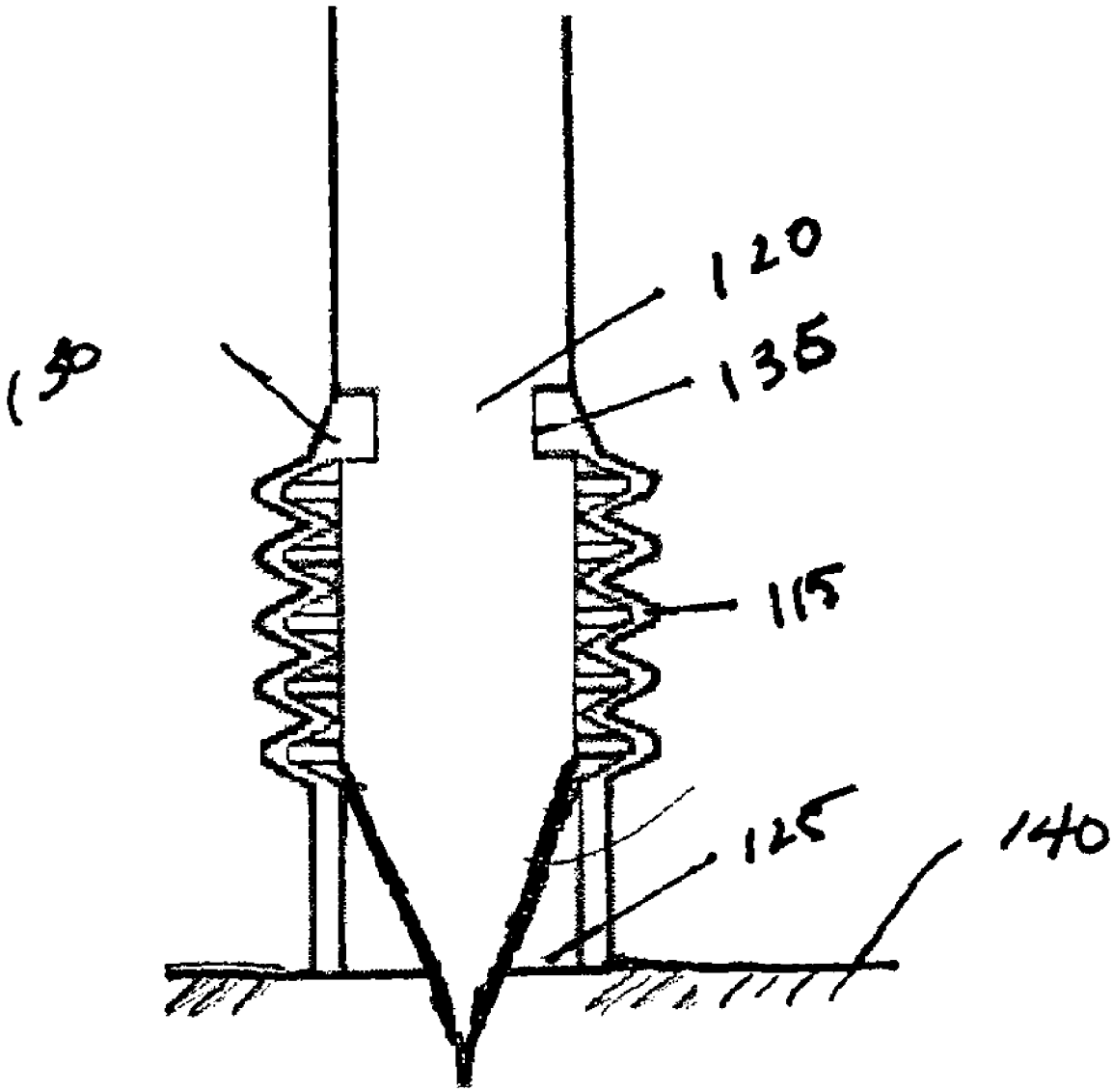
FIG. 6 is a preferred embodiment of a sectional view of the compressible point cover of the compass assembly of the present invention taken along line 5—5 of FIG. 2 in which the compressible point cover is under pressure applied by downward force.

In a preferred embodiment shown in detail in FIGS. 5 and 6, compressible point cover 115 has a first aperture 120 and a second aperture 125. First aperture 120 may be connected to first member 15 by any device including, but not limited to, a mechanical, adhesive or thermal connector. Preferably, first aperture 120 has a collar 130 that is positioned in a recess 135 in first member 15 to retain compressible point cover 115 to the first member. Preferably, collar 130 and recess 135 are circumferential, but any pattern of recesses and corresponding collar portions may be employed for connecting compressible point cover 115 to first member 15. Additionally, compressible point cover 115 preferably is made from an elastomeric plastic so that collar 130 is expandable to slide over cylindrical stem 90 of first member 15 and contractable upon alignment with recess 135. Thus, in the preferred embodiment, compressible point cover 115 is replaceable with little cost or effort because no additional fastener is needed for removal and replacement.

While first aperture 120 is connected to first member 15 by collar 130, second aperture 125 is free and extends past anchor point 95 thereby sheathing the anchor point 95 in the absence of pressure to second aperture 125, as shown in FIG. 5. When second aperture 125 is pressed against a surface 140, compressible point cover 115 compresses as depicted in FIG. 6. Thus, under pressure, compressible point cover 115 allows anchor point 95 to extend beyond second aperture 125 and to contact surface 140 at a point around which a user rotates compass assembly 10. When the user lifts compass assembly 10 from the surface, compressible point cover 115 extends automatically and returns anchor point 95 to an inoperable position, as shown in FIG. 5.

Figure 7:
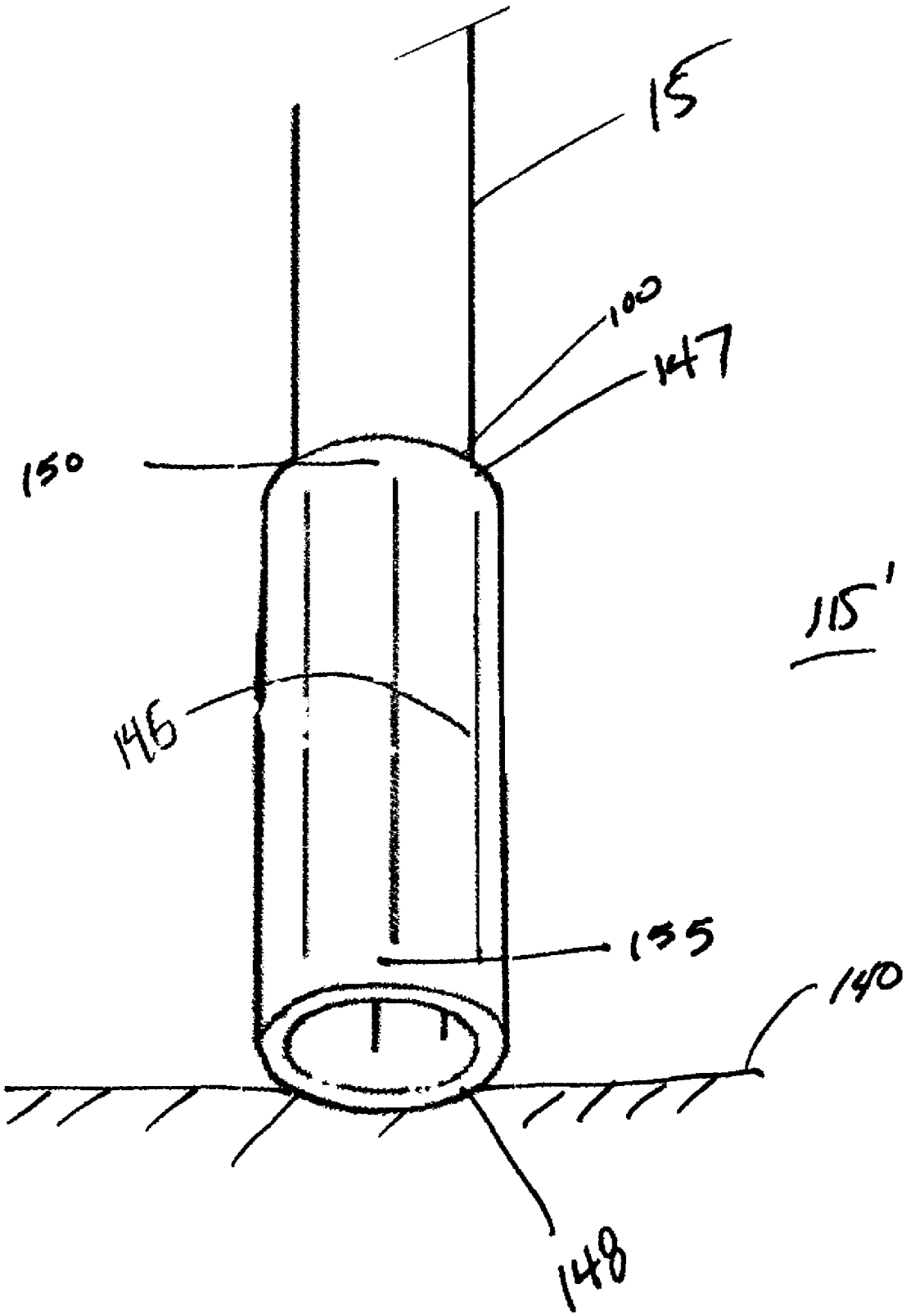
FIG. 7 is a sectional view of a first alternative embodiment of the compressible point cover of the compass assembly of the present invention taken along line 5—5 of FIG. 2 in which the compressible point cover is in a neutral position.
Figure 8:
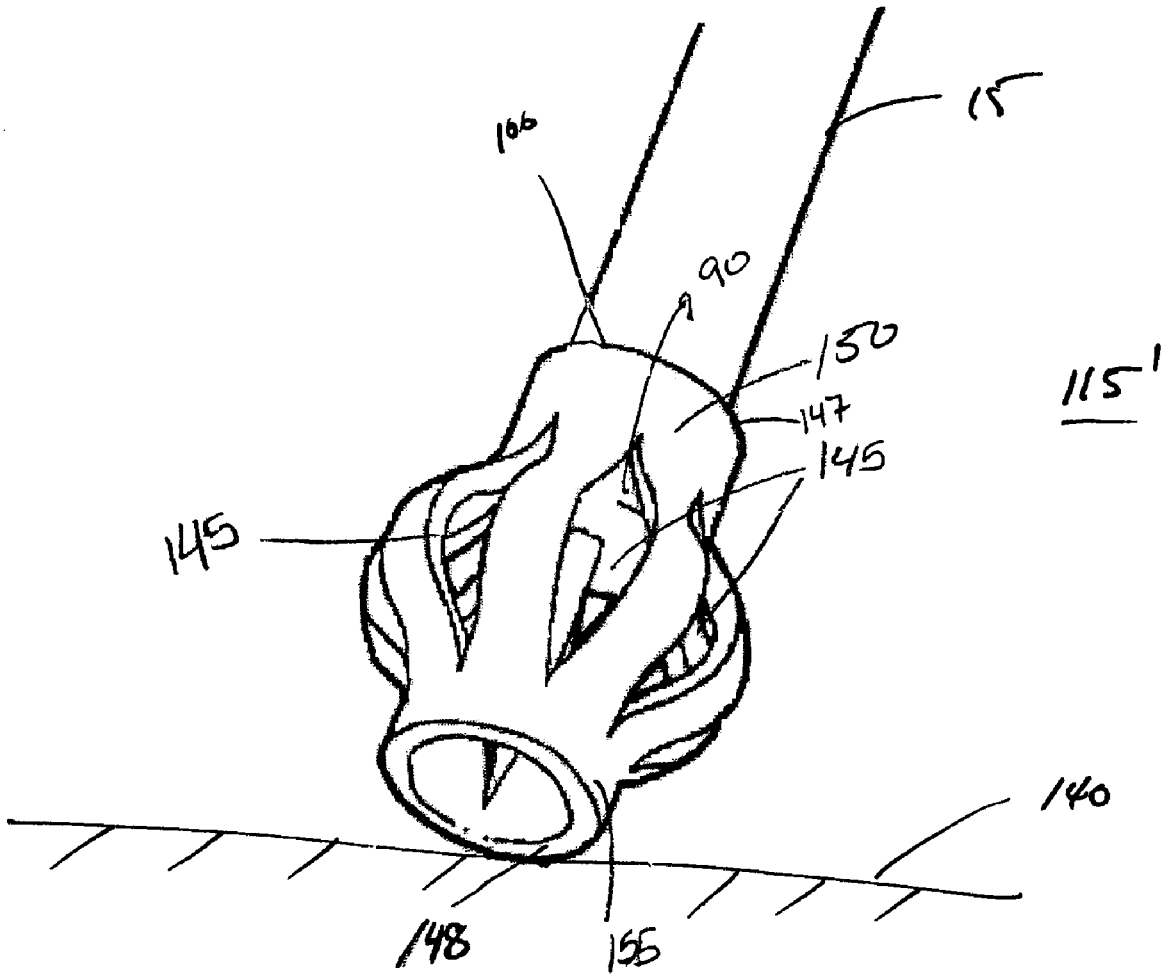
FIG. 8 is a sectional view of the first alternative embodiment of the compressible point cover of the compass assembly of the present invention taken along line 5—5 of FIG. 2 in which the compressible point cover is under pressure applied by downward force.

Compressible point cover 115 is preferably a generally cylindrical, unitary member. In a preferred embodiment, compressible point cover 115 may be, but is not limited to, a tube having expandable folds resembling a bellows, as shown in FIGS. 5 and 6. An alternative embodiment of compressible point cover 115' is shown in FIGS. 7 and 8. This compressible point cover 115' is a semi-rigid, tubular plastic extrusion with a series of slits 145, preferably vertical, that do not extend to either the first extrusion end 147 or the second extrusion end 148. Because slits 145 do not extend to first and second extrusion ends 147, 148, this embodiment of compressible point cover 115' has an unbroken upper sleeve 150 and an unbroken lower sleeve 155.

Slits 145 allow compressible point cover 115' to compress as second extrusion end 148 is pressed against surface 140, as shown in FIGS. 7 and 8. In this embodiment, first member 15 is inserted into unbroken upper sleeve 150 so that unbroken upper sleeve 150 encircles cylindrical ridge 100. Upper sleeve 150 may be connected to, and preferably affixed to, cylindrical ridge 100 by way of any device including, but not limited to, a mechanical, adhesive, or thermal connector. Alternatively, upper sleeve 150 may stretch to encircle cylindrical ridge 100 and then contract to securely remain positioned against cylindrical ridge 100 by constrictive force.

Figure 9:
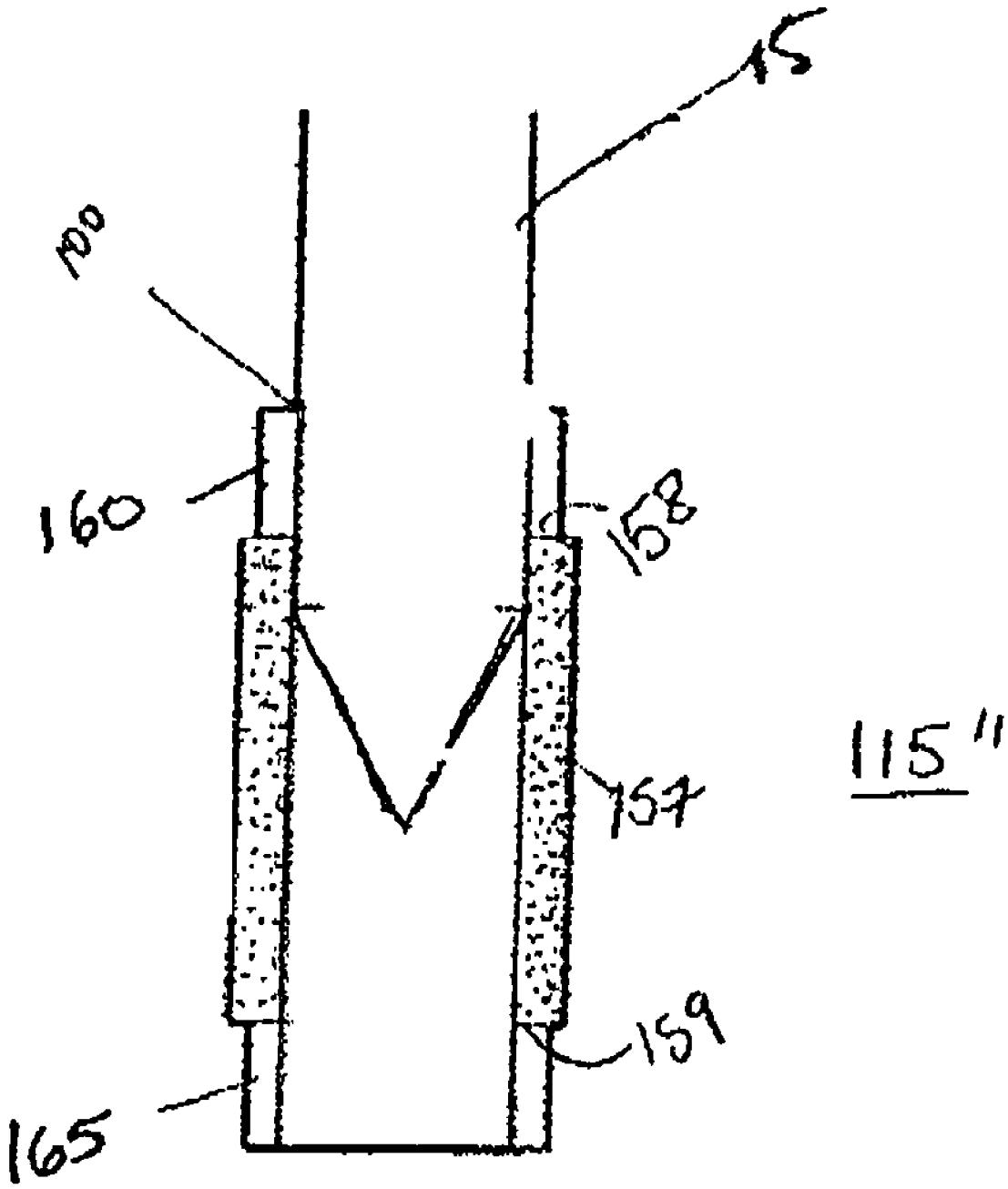
FIG. 9 is a sectional view of a second alternative embodiment of the compressible point cover of the compass assembly of the present invention taken along line 5—5 of FIG. 2 in which the compressible point cover is in the neutral position.
Figure 10:
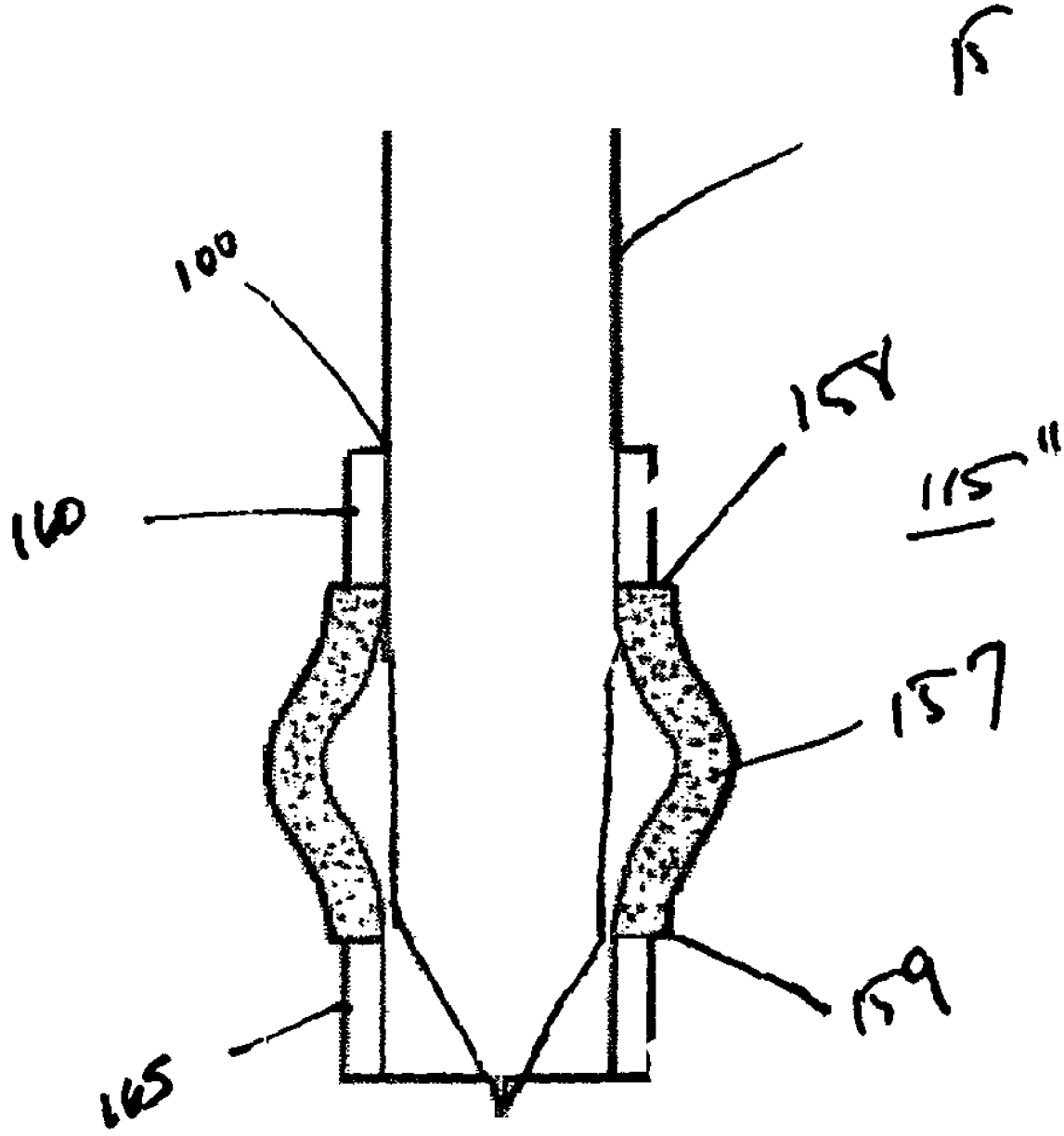
FIG. 10 is a sectional view of a second alternative embodiment of the compressible point cover of the compass assembly of the present invention taken along line 5—5 of FIG. 2 in which the compressible point cover is under pressure applied by downward force.

A second alternative embodiment of compressible point cover 115" is shown in FIGS. 9 and 10. Compressible point cover 115" provides a single, tubular elastomeric element 157 having a first tubular elastomeric extrusion end 158 and second tubular elastomeric extrusion end 159. First and second tubular elastomeric extrusion ends 158, 159 are each comolded to a first rigid plastic element 160 and a second rigid plastic element 165, respectively. First member 15 fits into first element 160 so that first element 160 contacts cylindrical ridge 100. First rigid plastic element 160 may be connected to cylindrical ridge 100 by way of any device including, but not limited to, a mechanical, adhesive, or thermal connector. Alternatively, first element 160 may merely expand to encircle cylindrical ridge 100 and then contract to securely remain positioned on cylindrical ridge 100.

Figure 11:
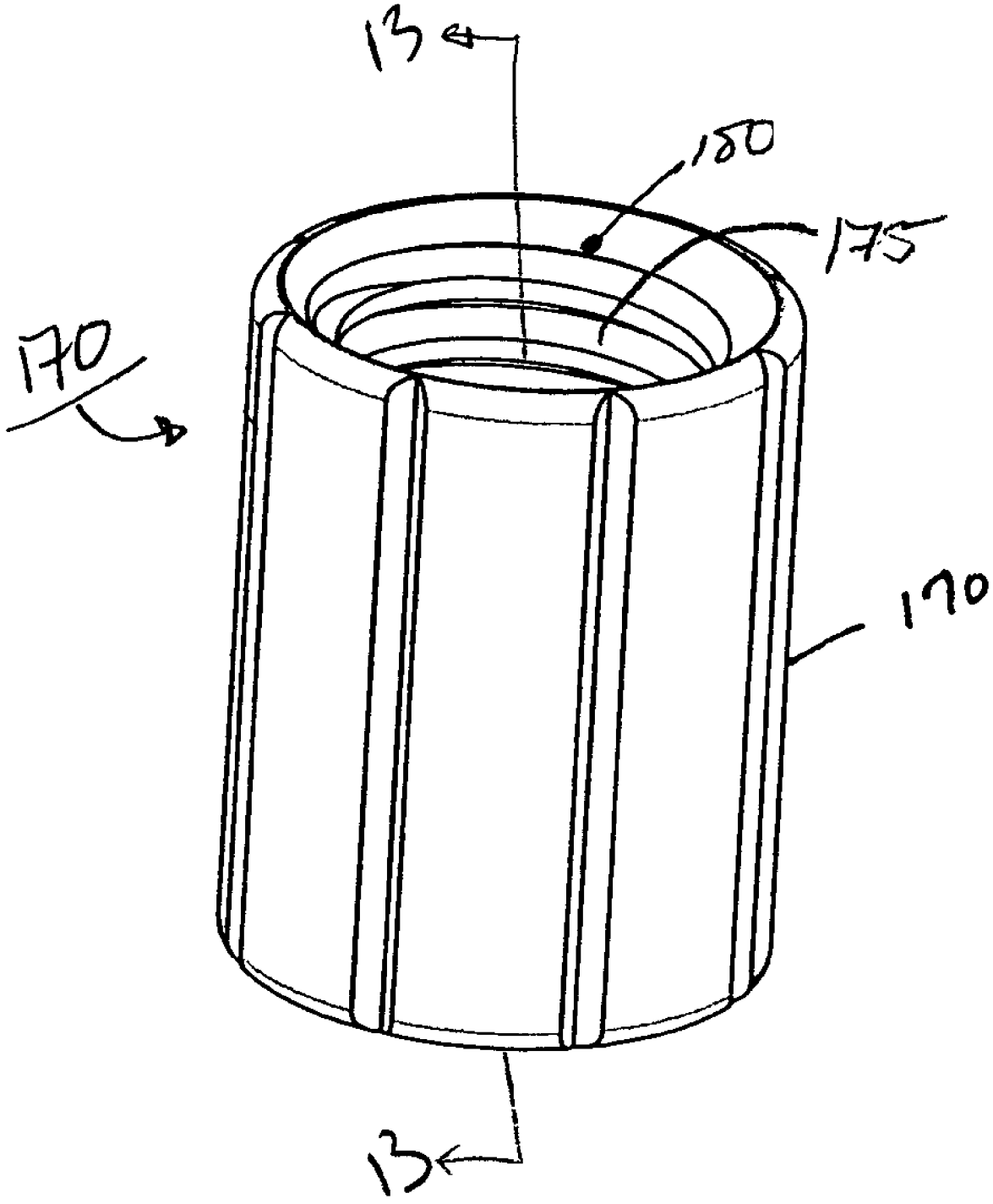
FIG. 11 is a rear view of the second member of the compass assembly of the present invention.
Figure 12:
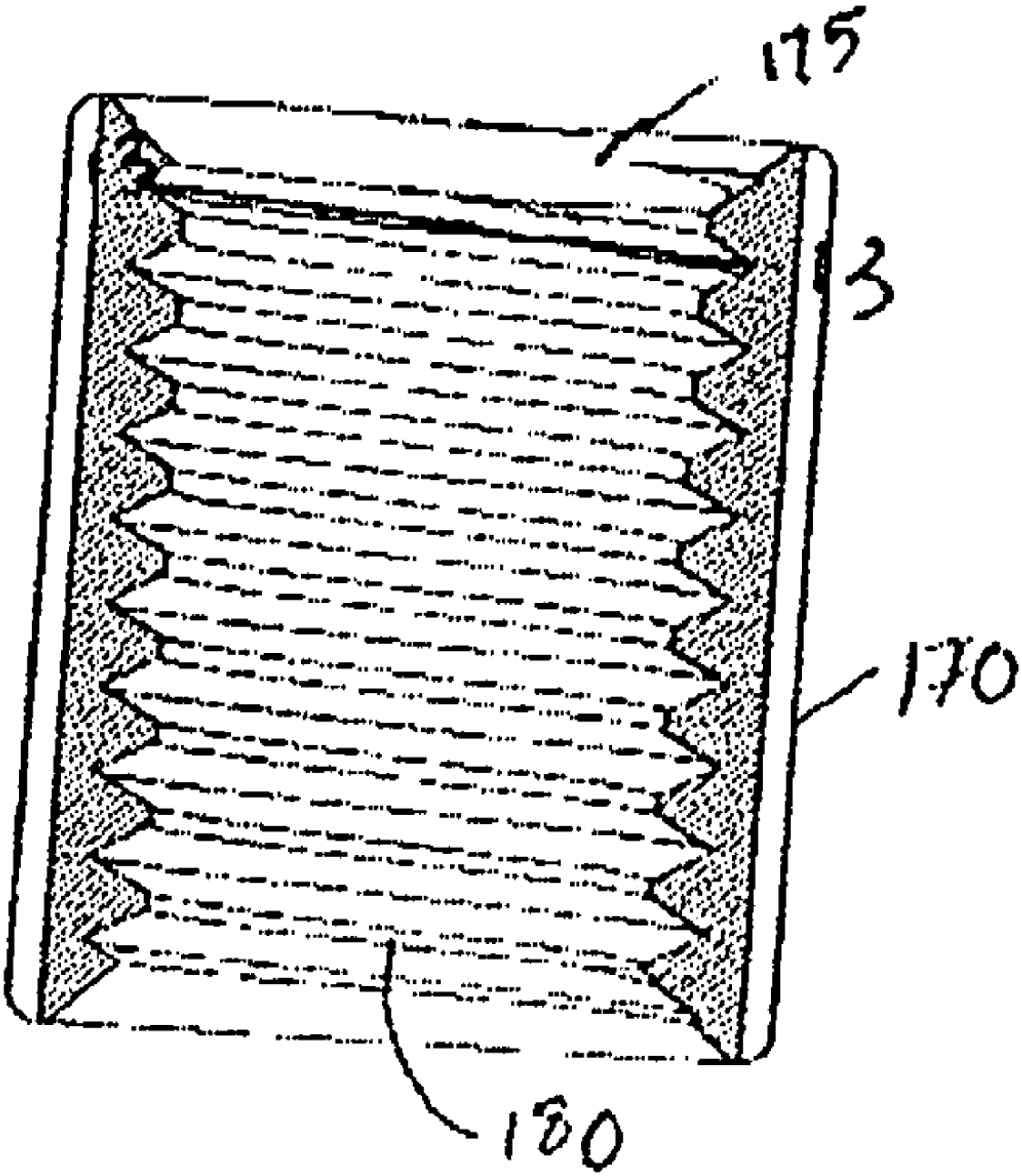
FIG. 12 is a perspective view of the fastening member of the compass assembly of the present invention.

As shown in FIG. 1, while first member 15 has compressible point cover 115, second member 20 has, opposite common point 60, a faster member 170 connected thereon or thereto. Fastener member 170 is preferably a cylindrical member having a hollow 175 therein to retain a marking utensil. Fastener member 170 more preferably has a threaded interior surface 180, as shown in FIGS. 11 and 12.

Figure 13:
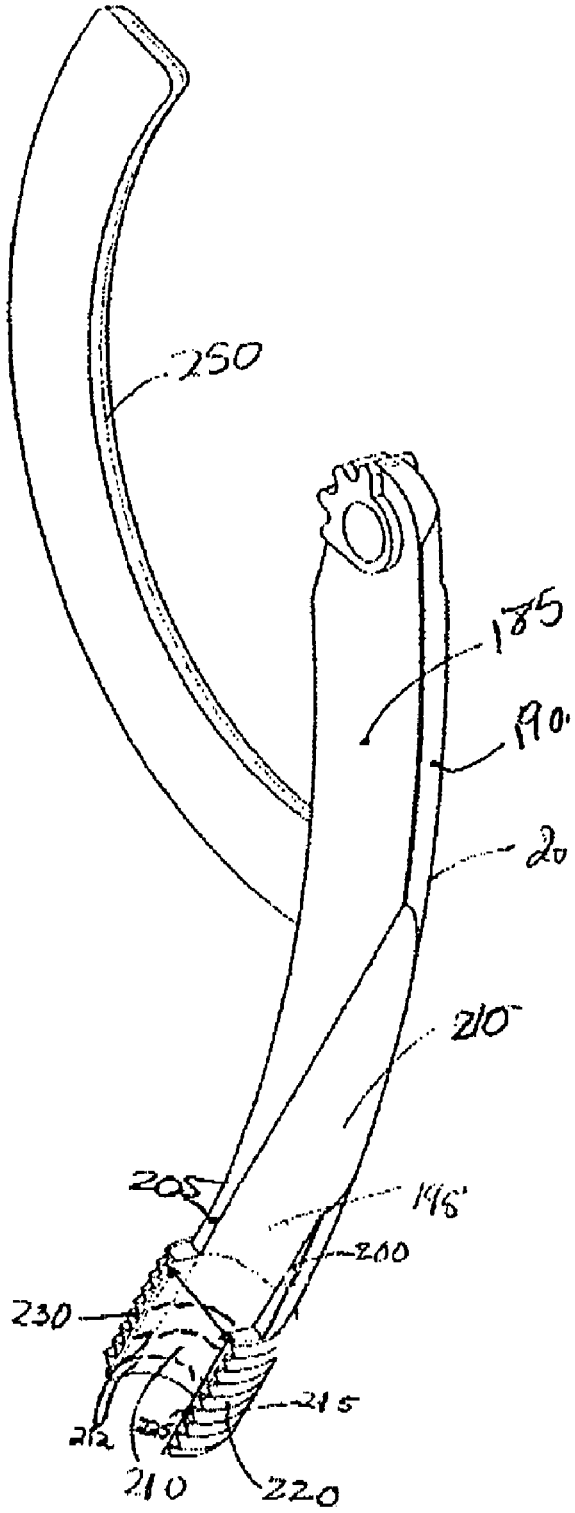
FIG. 13 is a sectional view of the fastening member of the present invention taken along line 13—13 of FIG. 12.

Referring to FIG. 13, second member 20 has two surfaces, a second relatively flat surface 185 opposite and adjoined to a second curved surface 190. Second surface 190 has a "U"-shaped linear groove 195 therein that is curved to form a holding space for a generally cylindrical marking utensil (not shown) and that is generally normal to the marking surface (not shown). "U"-shaped linear groove 195 has a first free edge 200 and a second free edge 205. Additionally, linear groove 195 has an interior surface 210 that optionally may have raised ridges 212 to prevent the cylindrical marking utensil from slipping.

Figure 3:
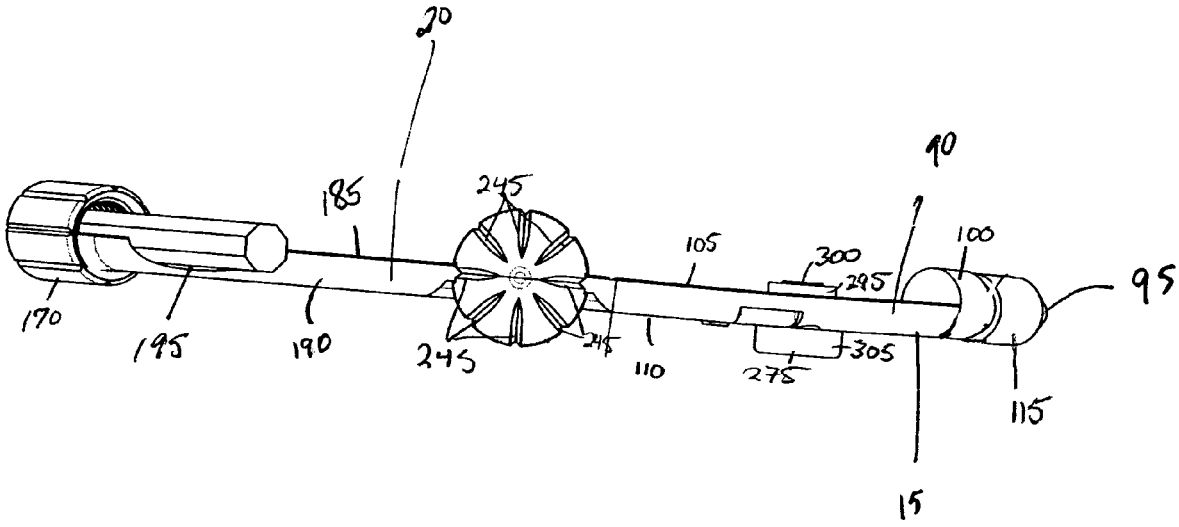
FIG. 3 is a top view of the compass assembly of the present invention.
Figure 4:
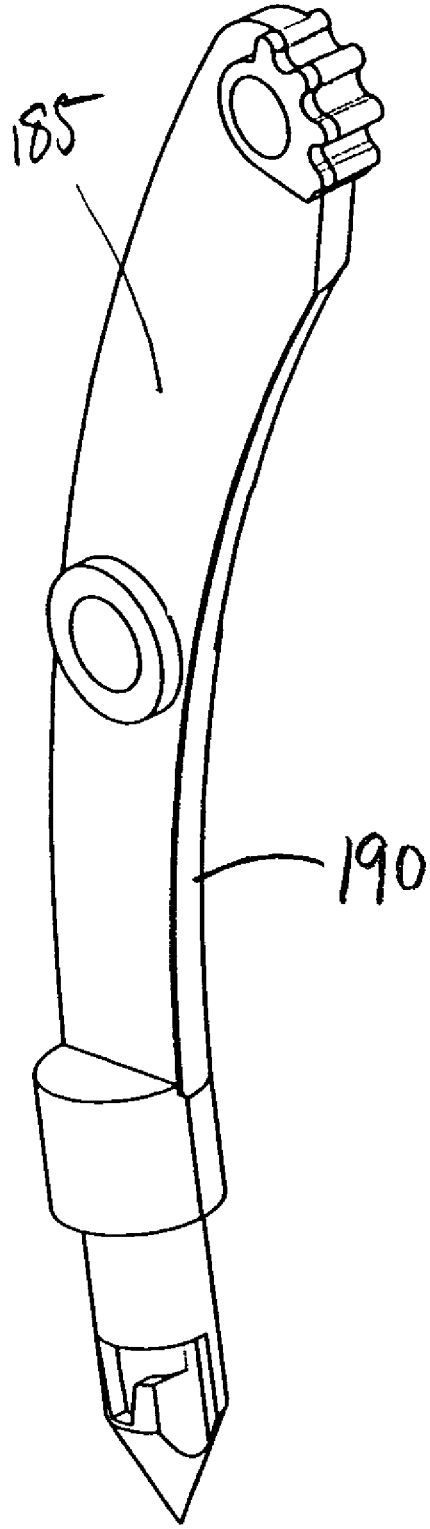
FIG. 4 is a rear view of the first member of the compass assembly of the present invention.

"U"-shaped linear groove 195 has a lower portion 215 that preferably has a threaded outer surface 220 for mating with faster member 170, as is shown in FIG. 3. Threaded outer surface 220 is "U"-shaped and has a first free upper edge 225 and a second free upper edge 230 that extend beyond second surface 185 and toward one another, as shown in FIG. 13. As fastener member 170 is threaded onto threaded outer surface 220, first and second free upper edges 225 and 230 flex and tighten around the marking utensil. The user may unthread fastener device 170 to release the marking utensil for repositioning, sharpening or replacement.

Although fastener member 170 preferably connects to second member 20 by threads, alternative fastener members may include, but are not limited to, clamping mechanisms or any other means known in the art. Additionally, the marking utensil may be permanently connected to compass assembly 10 and may allow for replacement of ink, lead, or another consumable marking medium.

Once the marking utensil is connected to second member 20 by fastener member 170, the user may describe an arc by rotating compass assembly 10 so that second member 20 and the marking utensil retained therein rotate around anchor point 95, which is anchored on surface 140. Because of its substantial size, girth, and bulbous shape, gripping member 25 enables a user to dexterously hold and spin compass assembly 10 with several fingers. This secure grip makes compass assembly 10 easier to manipulate.

Referring to FIG. 3, a series of ribs 245 comprise an outer surface of gripping member 25. Ribs 245 allow a user to press fingers into bulbous gripping member 25 for a secure grip. Further, gripping member 25 may be, but is not limited to, a teardrop design. Other designs for gripping member 25 may include, but are not limited to, large ribbed, peened, perforated or otherwise textured globes or cylinders.

Compass assembly 10 may optionally provide a distance guide 250, as shown in FIGS. 1 and 2. Distance guide 250 preferably has a measurement scale 255 for setting a radial distance of a described circle or arc. Measurement scale 255 may be in standard or metric increments and may be applied in any manner known in the art, such as silk screening, adhesive tape or by molding scale 255 into distance guide 250.

Distance guide 250 is shown as an arcuate member connected to second member 20 and extending through an arcuate notch 260 in first curved surface 110. First member 15 provides a pointer 265, shown in FIG. 1, for indicating a radius of a described arc on measurement scale 255. Pointer 265 may be applied in any manner known in the art, such as silk screening, adhesive tape or by molding pointer 265 into first member 15. Additionally, pointer 265 may be positioned anywhere along a peripheral edge 270 of arcuate notch 260 and measurement scale 255 may be positioned accordingly on distance guide 250 to provide an accurate measurement.

In addition to pointer 265, first member 15 preferably has a lock knob 275 positioned in a third bore 280, which is formed through first member 15 and located just below arcuate notch 260. Lock knob 275 may be connected to third bore 280 by press fit, threading, or any other attachment means. Preferably, lock knob 275 has a threaded stem 285 that mates with threads 290 in bore 280, allowing for adjustment. Lock knob 275 may be tightened to secure distance guide 250 so that first member 15 and second member 20 remain posited at a desired distance from one another.

Referring to FIG. 3, first surface 105 preferably has a raised member 295 thereon that encircles a lock knob end 300. Raised member 295 and lock knob end 300 are nearly flush. Raised member 295 thus aids in preventing lock knob 275 from dislodging when compass assembly 10 rests on first surface 105. Referring to FIG. 1, lock knob 275 preferably also has a retaining flange 305 positioned so that distance guide 250 does not dislodge from an arcuate notch 260 when first and second members 15, 20 pivot in a longitudinal axis with respect to each other.

The approximate location of distance guide 250, and arcuate notch 260, pointer 265, lock knob 275, third bore 280 and raised member 295 are shown, by way of example only, on respective first and second members 15, 20. However, these components may combine in different ways. For example, in an alternative embodiment (not shown), distance guide 250 may be molded onto first member 15, and arcuate notch 260, pointer 265, lock knob 275, third bore 280 and raised member 295 may be associated with second member 20. In another embodiment (not shown), distance guide 250 may be connected to gripping member 25, and first and second members 15, 20 each may have an arcuate notch 260, a pointer 265, a lock knob 275, a third bore 280 and a raised member 295.

All of the above listed components of compass assembly 10 are preferably fabricated from plastic, such as but not limited to, styrene, PVC, and nylon. Of course, wood, metal, a combination of plastic and metal, or other alternative materials may be used to construct compass assembly 10. It should be noted that a plastic compass assembly 10 will remain durable and anchor point 95 will be less damaging to a user than compasses manufactured with non-pliable materials.

Additionally, the plastic molding process allows first member 15 and anchor point 95 to be manufactured as a unitary component of compass assembly 10. Because compressible point cover 115 is preferably a unitary member and first member 15 and anchor point 95 comprise a unitary member, compass assembly 10 has a reduced number of components as compared to prior safety compass assemblies. Compass assembly 10 therefore reduces the overall complexity and presumably cost of assembly as compared to prior compasses with multiple component retractable shells and multiple component alternatives to anchor point 95.

Although compressible point cover 115 is applied to compass assembly 10, the present invention may apply to instruments of any design having a sharp end. Other examples of instruments to which the present invention may apply for the purpose of improving safety include, but are not limited to, pushpins, center punches, or even a tip of a marking device such as that inserted into compass assembly 10.

It should also be noted that the terms "first", "second", "third", "upper", "lower", and the like may be used herein to modify various elements. These modifiers do not imply a spatial, sequential, or hierarchical order to the modified elements unless specifically stated.

While the present invention has been described with reference to one or more exemplary embodiments, it will be understood by those skilled in the art that various changes may be made and equivalents may be substituted for elements thereof without departing from the scope of the invention. In addition, many modifications may be made to adapt a particular situation or material to the teachings of the disclosure without departing from the essential scope thereof. Therefore, it is intended that the present invention is not limited to the particular embodiment(s) disclosed as the best mode contemplated for carrying out this invention, but that this invention will include all embodiments falling within the scope of the appended claims.

What is claimed is:

1. A compass assembly comprising:

a first member;

a second member pivotally connected to said first member at a common end, wherein said first member has an anchor point opposite said common end and said second member retains a marking device opposite said common end; and a compressible cover being connected to said first member and positioned over said anchor point, wherein said compressible cover is a bellows.

2. A compass assembly comprising:

a first member;

a second member being pivotally connected to said first member;

a gripping member being connected to said first member and said second member; and a compressible cover being positioned on said first member and around a pointed end of said first member, wherein said compressible cover is elastomeric, wherein said compressible cover is a hollow tube, and wherein said compressible cover is pleated.

* * * * *